US005843274A

United States Patent [19]

Chou

[11] Patent Number: 5,843,274

[45] Date of Patent: Dec. 1, 1998

[54] HOT PRESS ROLLER

[76] Inventor: Ching-Shin Chou, 58, Ma Yuan West St., Taichung, Taiwan

[21] Appl. No.: 972,185

[22] Filed: Nov. 18, 1997

[51] Int. Cl.[6] ..... B30B 3/00

[52] U.S. Cl. ..... 156/582; 156/498; 156/555; 492/46

[58] Field of Search ..... 156/498, 555, 156/580, 582, 583.1; 492/46, 48, 60

[56] References Cited

U.S. PATENT DOCUMENTS

| | | | |
|---|---|---|---|
| 3,331,434 | 7/1967 | Lockhart | 165/89 |
| 4,658,486 | 4/1987 | Schonemann | 492/46 |
| 5,072,497 | 12/1991 | Zaorlek et al. | 492/46 |
| 5,383,833 | 1/1995 | Brugger et al. | 492/16 |
| 5,549,154 | 8/1996 | Niskanen et al. | 165/89 |

*Primary Examiner*—James Sells

[57] ABSTRACT

A hot press roller has an outer pipe, an inner pipe inserted in the outer pipe, an annular separator disposed in a first end of the outer pipe, a separation ring disposed in a second end of the outer pipe, a round center hole formed on the annular separator, a circular center hole formed on the separation ring, a first end of the inner pipe passing through the round center hole, a second end of the inner pipe passing through the circular center hole, a water outlet tube connected to the first end of the inner pipe, and a water inlet tube connected to the second end of the inner pipe. A first safety valve is disposed on the annular separator. A second safety valve is disposed on the separation ring. A cooling agent filling tube is disposed on the separation ring.

1 Claim, 2 Drawing Sheets

HOT PRESS ROLLER

BACKGROUND OF THE INVENTION

The present invention relates to a hot press roller. More particularly, the present invention relates to a hot press roller which has a cooling pipe device.

A conventional hot press roller does not have an inner pipe therein. Therefore, the interior of the conventional hot press roller can contain water only. However, the thermal conductivity of water is not very good. The temperature of the surface of the conventional hot press roller will be too high so that the product may be deformed or crinkled.

SUMMARY OF THE INVENTION

An object of the present invention is to provide a hot press roller which has an inner pipe and an outer pipe defining an interior for receiving a cooling agent in order to lower a temperature of the surface of the hot press roller.

Accordingly, a hot press roller comprises an outer pipe, an inner pipe inserted in the outer pipe, an annular separator disposed in a first end of the outer pipe, a separation ring disposed in a second end of the outer pipe, a round center hole formed on the annular separator, a circular center hole formed on the separation ring, a first end of the inner pipe passing through the round center hole, a second end of the inner pipe passing through the circular center hole, a water outlet tube connected to the first end of the inner pipe, and a water inlet tube connected to the second end of the inner pipe. A first safety valve is disposed on the annular separator. A second safety valve is disposed on the separation ring. A cooling agent filling tube is disposed on the separation ring.

DETAILED DESCRIPTION OF THE INVENTION

Figure 1:
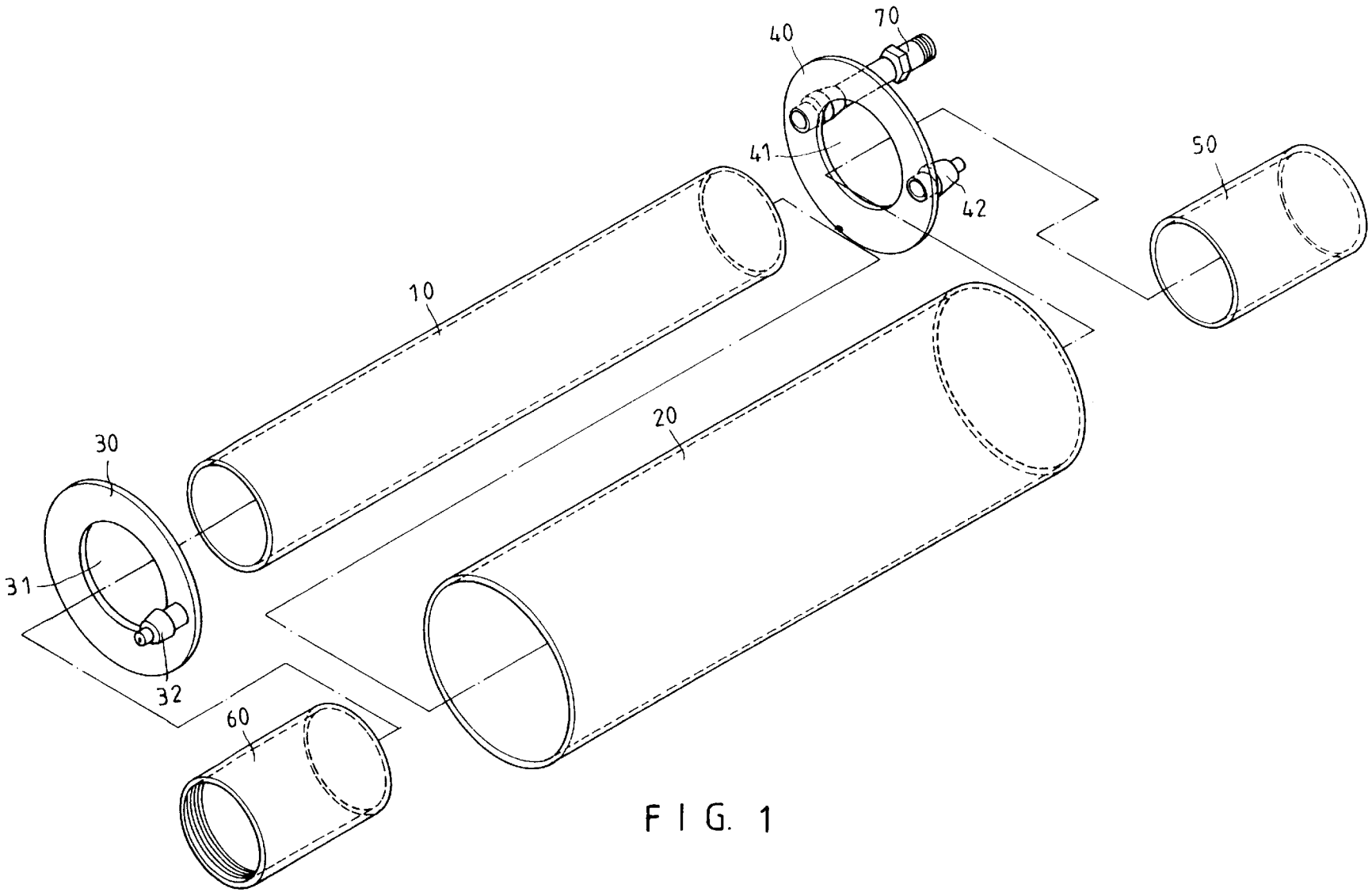
FIG. 1 is a perspective exploded view of a hot press roller of a preferred embodiment in accordance with the present invention.
Figure 2:
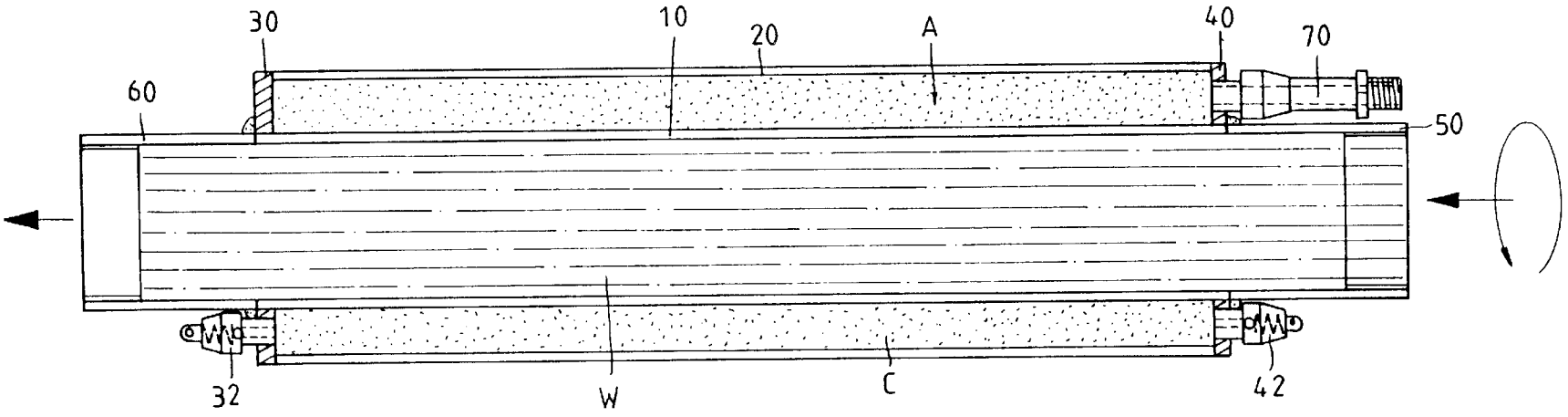
FIG. 2 is a sectional assembly view of a hot press roller of a preferred embodiment in accordance with the present invention.

Referring to FIGS. 1 and 2, a hot press roller comprises an outer pipe 20, an inner pipe 10 inserted in the outer pipe 20, an annular separator 30 disposed in a first end of the outer pipe 20, a separation ring 40 disposed in a second end of the outer pipe 20, a round center hole 31 formed on the annular separator 30, a circular center hole 41 formed on the separation ring 40, a first end of the inner pipe 10 passing through the round center hole 31, a second end of the inner pipe 10 passing through the circular center hole 41, a water outlet tube 60 connected to the first end of the inner pipe 10, and a water inlet tube 50 connected to the second end of the inner pipe 10. A first safety valve 32 is disposed on the annular separator 30. A second safety valve 42 is disposed on the separation ring 40. A cooling agent filling tube 70 is disposed on the separation ring 40. The water outlet tube 60 and the first end of the inner pipe 10 are welded together. The water inlet tube 50 and the second end of the inner pipe 10 are welded together. Water W is filled in the inner pipe 10. A cooling agent C is filled in an interior A defined between the inner pipe 10 and the outer pipe 20. When the temperature of the outer pipe 20 is too high, the cooling agent becomes vapor. If the inner pressure of the interior between the inner pipe 10 and the outer pipe 20 is too high, the vapor can be exhaled via the first safety valve 32 and the second safety valve 42. The cooling agent C can decrease the temperature of the outer pipe 20 effectively. Since the thermal conductivity of the cooling agent C is excellent, the thermal energy can be transferred to water in the inner pipe 10. Water can be circulated also.

The present invention has the following advantages.

The cooperation of the water and the cooling agent can decrease the temperature of the outer pipe effectively.

The first safety valve and the second safety valve can release the high pressured vapor effectively.

When the amount of the cooling agent in the interior between the inner pipe and the outer pipe is decreased, new cooling agent can be filled again via the cooling agent filling tube.

Therefore, the product will not be deformed or crinkled.

The present invention is not limited to the above embodiment but various modification thereof may be made. Furthermore, various changes in form and detail may be made without departing from the scope of the present invention.

I claim:

1. A hot press roller comprises:

an outer pipe, an inner pipe inserted in the outer pipe, an annular separator disposed in a first end of the outer pipe, a separation ring disposed in a second end of the outer pipe, a round center hole formed on the annular separator, a circular center hole formed on the separation ring, a first end of the inner pipe passing through the round center hole, a second end of the inner pipe passing through the circular center hole, a water outlet tube connected to the first end of the inner pipe, a water inlet tube connected to the second end of the inner pipe, a first safety valve disposed on the annular separator, a second safety valve disposed on the separation ring, and a cooling agent filling tube disposed on the separation ring.

* * * * *